US010171913B2

(12) United States Patent
Nicoletti

(10) Patent No.: US 10,171,913 B2
(45) Date of Patent: Jan. 1, 2019

(54) SUSPENSION DEVICE FOR A LOUDSPEAKER, MANUFACTURING METHOD AND ASSOCIATED LOUDSPEAKERS

(71) Applicant: FOCAL JMLAB, La Talaudiere (FR)

(72) Inventor: Giuliano Nicoletti, La Talaudiere (FR)

(73) Assignee: FOCAL JMLAB, La Talaudiere (FR)

( * ) Notice: Subject to any disclaimer, the term of this patent is extended or adjusted under 35 U.S.C. 154(b) by 0 days.

(21) Appl. No.: 15/565,782

(22) PCT Filed: Apr. 12, 2016

(86) PCT No.: PCT/EP2016/058035
§ 371 (c)(1),
(2) Date: Oct. 11, 2017

(87) PCT Pub. No.: WO2016/166111
PCT Pub. Date: Oct. 20, 2016

(65) Prior Publication Data

US 2018/0124519 A1 May 3, 2018

(30) Foreign Application Priority Data

Apr. 15, 2015 (FR) ..... 15 53311

(51) Int. Cl.
*H04R 7/18* (2006.01)
*H04R 7/26* (2006.01)
*H04R 31/00* (2006.01)

(52) U.S. Cl.
CPC ..... *H04R 7/18* (2013.01); *H04R 7/26* (2013.01); *H04R 31/003* (2013.01);
(Continued)

(58) Field of Classification Search
CPC ... H04R 7/18; H04R 7/20; H04R 7/22; H04R 7/26; H04R 31/003; H04R 2307/201; H04R 2307/207; H04R 2400/11
See application file for complete search history.

(56) References Cited

U.S. PATENT DOCUMENTS 2,302,178 A * 11/1942 Brennan ..... H04R 7/20 181/169
2,490,466 A * 12/1949 Olson ..... H04R 7/20 181/172

(Continued)

FOREIGN PATENT DOCUMENTS

GB 2471884 A 1/2011

OTHER PUBLICATIONS

ISA/European Patent Office International Search Report and Written Opinion for Corresponding PCT/EP2016/058035 (French and English Lanugages), dated Jun. 20, 2016 (14 pgs).

(Continued)

*Primary Examiner* — Joshua Kaufman
(74) *Attorney, Agent, or Firm* — Harris Beach PLLC

(57) ABSTRACT

The invention relates to a suspension device for a loudspeaker, comprising an annular outer edge that is able to fasten the suspension device to a frame, an annular inner edge that is able to fasten the suspension device to a membrane, a suspension hoop that extends annularly between the edges, said suspension hoop being able to absorb movement stresses produced at the inner edge by means of a deformation that thus forms a resonance mode, the suspension hoop comprising at least one annular protuberance that is positioned so as to minimize the at least one resonance mode of the suspension hoop, the mass of the at least one annular protuberance being between 150% and (Continued)

400% the mass of a part of the suspension hoop on which the at least one annular protuberance is positioned.

5 Claims, 6 Drawing Sheets

(52) U.S. Cl.
CPC .. *H04R 2307/201* (2013.01); *H04R 2307/207* (2013.01); *H04R 2400/11* (2013.01)

(56) References Cited

U.S. PATENT DOCUMENTS 2,863,520 A * 12/1958 Manley ..... H04R 7/20 181/171
3,645,356 A * 2/1972 Sotome ..... H04R 7/20 181/172
5,418,337 A * 5/1995 Schreiber ..... H04R 7/12 181/171
5,521,886 A * 5/1996 Hirosawa ..... B29C 45/1639 29/594
5,719,946 A * 2/1998 Terauchi ..... H04R 9/063 181/163
6,385,327 B1 * 5/2002 D'Hoogh ..... F16F 15/073 381/398
7,275,620 B1 * 10/2007 Diedrich ..... H04R 7/16 181/171
7,480,390 B2 * 1/2009 Tabata ..... H04R 7/20 181/172
2002/0051558 A1 * 5/2002 Kuze ..... H04R 7/12 381/404
2003/0068064 A1 * 4/2003 Czerwinski ..... H04R 7/20 381/398
2003/0228027 A1 12/2003 Czerwinski
2004/0218780 A1 * 11/2004 Lee ..... H04R 7/18 381/426
2012/0114164 A1 * 5/2012 Oclee-Brown ..... H04R 7/20 381/398
2013/0056296 A1 * 3/2013 Goossens ..... H04R 7/14 181/157
2013/0058521 A1 * 3/2013 Davidson ..... H04R 7/18 381/398
2016/0021462 A1 * 1/2016 Tomizawa ..... H04R 7/18 381/412
2016/0050496 A1 * 2/2016 Lai ..... G10K 13/00 181/173
2018/0124519 A1 * 5/2018 Nicoletti ..... H04R 7/18
2018/0242086 A1 * 8/2018 Skellett ..... H04R 9/06

OTHER PUBLICATIONS

Klippel, Wolfgang, et al., "Measurement and Visualization of Loudspeaker Cone Vibration", 2006, Audio Engineering Society Convention Paper 6882 (pp. 1-18).

* cited by examiner

SUSPENSION DEVICE FOR A LOUDSPEAKER, MANUFACTURING METHOD AND ASSOCIATED LOUDSPEAKERS

CROSS-REFERENCE TO RELATED APPLICATIONS

This application is a national stage application under 35 U.S.C. § 371 of PCT Application No. PCT/EP2016/058035, filed on Apr. 12, 2016, which claims priority to and the benefit of French Application No. 1553311 filed on Apr. 15, 2015, which are incorporated herein by reference in their entirety.

TECHNICAL DOMAIN

The invention relates to the field of acoustic material. It concerns a loudspeaker suspension device, and more specifically a suspension device connecting the frame of a loudspeaker to a membrane. It also concerns a manufacturing process for the suspension device as well as a loudspeaker comprising this suspension device. The purpose of the invention is more specifically a new suspension device which has benefits in terms of acoustic performance, particularly with regard to the smoothness of the frequency response curve.

PRIOR ART

In general, a loudspeaker comprises a fixed frame and a mobile annular membrane mechanically associated with a coil, through which a current representing the acoustic signal to be generated passes. The loudspeaker also comprises a magnetic field source, generally constant, which interacts with the current passing through the coil in order to allow the coil to move and therefore also the membrane.

The movements of the annular membrane in relation to the frame are guided by an annular suspension device comprising an annular outer edge that is able to fasten the suspension device to the frame and an annular inner edge that is able to fasten the suspension device to the annular membrane. Between these two annular edges, the suspension device comprises a suspension hoop in order to absorb movement stresses produced at the inner edge.

However, during the absorption of movement stresses, suspension hoop deformations create oscillations around the position of the suspension hoop when it is not situated at an absorption location. These oscillations can resonate and form a resonance mode, thus degrading the quality of the acoustic wave emitted by the loudspeaker.

In order to eliminate these resonance modes, it is known that the rigidity of the suspension hoop needs to be increased. The U.S. Pat. No. 7,463,749 proposes three hemi-toroidal protuberances under the suspension hoop in order to increase the rigidity thereof and to limit deformations. The United States patent application US 2002/005158 also proposes the positioning of hemi-toroidal protuberances at the center of the suspension hoop.

However, the rigidity of the suspension hoop affects the dynamics of the loudspeaker, i.e., the period of time necessary for the loudspeaker membrane to move when a current is applied to it. In an ideal loudspeaker, the membrane is free in air and when a movement signal is applied to the membrane, it responds directly by performing a movement. The first function of the suspension device is to guide the movement of the membrane in translation, but it constitutes a hindrance to the movement of the membrane insofar as it must overcome the rigidity of the suspension hoop in order to perform a movement in following a signal. Thus, the solution of the U.S. Pat. No. 7,463,749 and of the United States patent application US 2002/005158, consisting of limiting the deformations of the suspension hoop, is not optimal because it strongly degrades the dynamics of the loudspeaker.

The patent application US 2003/0228027 proposes positioning one or two partially toroidal protuberances on the suspension hoop in order to limit these deformations. It also proposes limiting the rigidity of the suspension hoop using an annular profile of slot shaped protuberances. The profile of protuberances in the form of a slot limits the weight of the suspension hoop and comprises recesses wherein the length is determined by means of empirical testing.

However, to identify and trace the frequency response of a loudspeaker is a complex operation that often takes a long time and that calls for specialized equipment such as an anechoic chamber. The empirical definition of the form of the slots associated with each loudspeaker range is therefore a particularly long operation.

In addition, the protuberances of patent application US 2003/0228027 do not follow the annular shape of the suspension hoop. The annular resonances induced by the slot shape must be dampened in order not to degrade the performance of the loudspeaker thus limiting the effectiveness of this device.

The technical problem of the invention is therefore to effectively absorb the resonance modes of a loudspeaker suspension device without impacting negatively upon the performance of the suspension device.

DESCRIPTION OF THE INVENTION

The present invention aims to provide a device that is easier to make using a suspension hoop that is capable of effectively absorbing oscillations and wherein the weight is dampened by means of at least one protuberance, the position thereof being determined according to the position of the resonance mode.

According to one aspect of the invention, the latter relates to a suspension device for a loudspeaker, this device comprising an annular outer edge able to fasten the suspension device to the frame, an annular inner edge able to fasten the suspension device to a membrane, and a suspension hoop extending annularly between the inner and outer edges.

This suspension hoop is able to absorb movement stresses produced at the inner edge by means of deforming the suspension hoop thus forming at least one resonance mode. This suspension hoop comprises at least one annular protuberance positioned in such a way as to minimize at least one suspension hoop resonance mode, the mass of each of these annular protuberances being between 150% and 400% of the mass of a part of the suspension hoop whereupon the annular protuberance is positioned.

The invention thus makes it possible to quickly and accurately define the positions of protuberances that are able to significantly reduce resonances. Furthermore, the dampened weight of the protuberances limits the impact of these protuberances upon the dynamics of the loudspeaker.

For the purposes of the invention, an annular protuberance positioned in such a way as to minimize at least one resonance mode of the suspension hoop corresponding to a protrusion wherein a positioning study was performed when the suspension hoop was not provided with the protuberance in such a way as to locate at least one resonance mode of the suspension hoop. This protuberance is therefore different from the protuberances of the United States patent application US 2002/005158, which are simply positioned in the middle of the suspension hoop without taking into consideration at least one resonance mode of the suspension hoop.

According to one embodiment, this annular protuberance forms an even thickness of material with a circular radial cross-section. This form of protuberance is particularly simple to dampen in terms of weight. In addition, adjustments to the dynamics of the speaker can be made by changing the radius of the annular radial cross-section of the protuberance.

According to an embodiment, the mass of at least one annular protuberance corresponds to approximately 250% of the mass of a part of the suspension hoop whereupon the annular protuberance is positioned. This value makes it possible to reach a compromise that is particularly suited to the dynamics of the loudspeaker and the need to reduce the resonances of the suspension hoop.

According to an embodiment, a device comprises one, two, or three protuberances.

According to a second aspect of the invention, the invention concerns a manufacturing process for a loudspeaker suspension device as described above comprising the steps of:

- exciting the inner edge of the suspension device,
- measuring the movements of the suspension hoop in relation to a stable state of the suspension hoop during a characterization period,
- detecting the position of the first local maximum of the movements of the suspension hoop in relation to a stable state of the suspension hoop,
- defining a position of a protuberance corresponding to a projection of the first local maximum on the suspension hoop in the stable state.

This manufacturing process makes it possible to determine the position of the protuberances that are able to significantly reduce the oscillations by means of a single digital analysis of the movements of the suspension hoop. The position of the local maximum in relation to the stable state of the suspension hoop makes it possible to highlight both the peaks and troughs resulting from the deformations of the suspension hoop.

According to one embodiment, the step composed of defining a position of a protuberance comprises the steps of:

- defining at least a set of positions wherein the distance between the positions is less than 20% of the total distance of the suspension hoop in the stable state, and
- determining an average position of at least a set of positions corresponding to the position of the protuberance.

This embodiment makes it possible to eliminate double positions detected using an average wherein the accuracy of 20% is particularly suitable.

According to one embodiment, the step consisting in exciting the inner edge of the suspension device is performed with a characteristic signal wherein the frequencies change within a predetermined frequency range, preferably between 100 Hz and 10 KHz. It is well known that very high-end suspension devices are implemented in order to be effective over a characteristic frequency range. This embodiment makes it possible to manufacture a suspension device that is particularly adapted to the characteristic frequency range thereof.

According to an embodiment, the process comprises the steps of:

- digitally modeling the dynamics of the suspension device according to measurements of the movements of the suspension hoop in relation to a stable state of the suspension hoop during a characterization period,
- defining the size of the protuberance by means of a digital simulation of the previously defined model in such a way as to minimize the resonance, modes and limit the impact of the weight of the protuberance.

This embodiment makes it possible to numerically define the size of the protuberance thus improving the resonance reduction performance and limiting the impact of the weight of the protuberances upon the suspension hoop.

According to an embodiment, the process comprises the following steps:

- once again exciting the inner edge of the suspension device that has been improved when an annular protuberance has been positioned on the device and when the suspension device still has harmful resonance modes.
- measuring the movements of the improved suspension hoop during a second characterization period, i.e., using the annular protuberance, in relation to a stable state of the suspension hoop,
- detecting the position of the second local maximum of the movements of the improved suspension hoop in relation to a stable state of the suspension hoop,
- defining a position of a second protuberance corresponding to a projection of the second local maximum on the improved suspension hoop in the stable state.

This embodiment makes it possible to position a second protuberance in order to further limit the resonance modes of the suspension device. Alternatively, these steps can be repeated in order to add a third protuberance if the limitation of the resonance modes is still insufficient.

According to a third aspect, the invention relates to a loudspeaker comprising a frame, a membrane movable in translation, and a suspension device as previously described.

BRIEF DESCRIPTION OF THE FIGURES

The method for implementing the invention and its advantages will become more apparent from the following disclosure of the embodiments, given by way of a non-limiting example, supported by the attached figures wherein

FIG. 1: a radial sectional view of a suspension device in a stable state;

FIG. 2: a radial sectional view of the suspension device of FIG. 1 in a first excitation state;

FIG. 3: a radial sectional view of the suspension device of FIG. 1 in a second excitation state;

FIG. 4: a radial sectional view of the suspension device of FIG. 1 in a third excitation state;

FIG. 5: a radial sectional view of the suspension device of FIG. 1 in a step consisting of defining the sets of positions;

FIG. 6: a radial sectional view of the suspension device of FIG. 1 in a step consisting of defining an average position;

FIG. 7: a radial sectional view of a suspension device provided with three annular protuberances according to a first embodiment of the invention;

FIG. 8: an enlargement of the radial protuberance of FIG. 7;

FIG. 9: a perspective and radial sectional view of a suspension device provided with two annular protuberances according to a second embodiment of the invention;

FIG. 10: a perspective and radial sectional view of a suspension device provided with two annular protuberances according to a third embodiment of the invention; and FIG. 11: a perspective and radial sectional view of a suspension device provided with only one annular protuberance according to a fourth embodiment of the invention;

DETAILED DESCRIPTION OF THE INVENTION

Figure 1:
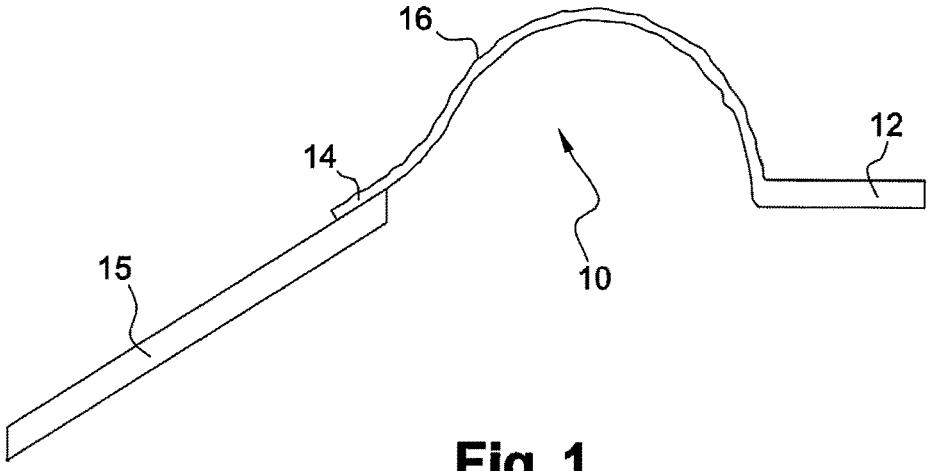
FIGS. 1 to 11 represent.

FIGS. 1 to 8 describe the process for implementing the suspension device according to the invention. In a first step a suspension device 10 to be improved is shown in FIG. 1 in a stable state. The suspension device 10 comprises a fixed annular outer edge 12 and a fixed annular inner edge 14 fastened to a membrane 15 that is mobile in translation. A suspension device 16 annularly connects to the two edges 12, 14. The membrane 15 is then moved in order to measure the movements induced by the suspension hoop 16 during the characterization period. Preferably, the membrane 15 is moved at frequencies within a frequency range associated with the suspension device. Preferably, the membrane 15 excitation signal corresponds to a sinusoidal signal wherein the amplitude is constant and wherein the frequency is variable between a low frequency and a high frequency within the frequency range, for example, within the frequency range 100 Hz to 10 KHz.

Figure 2:
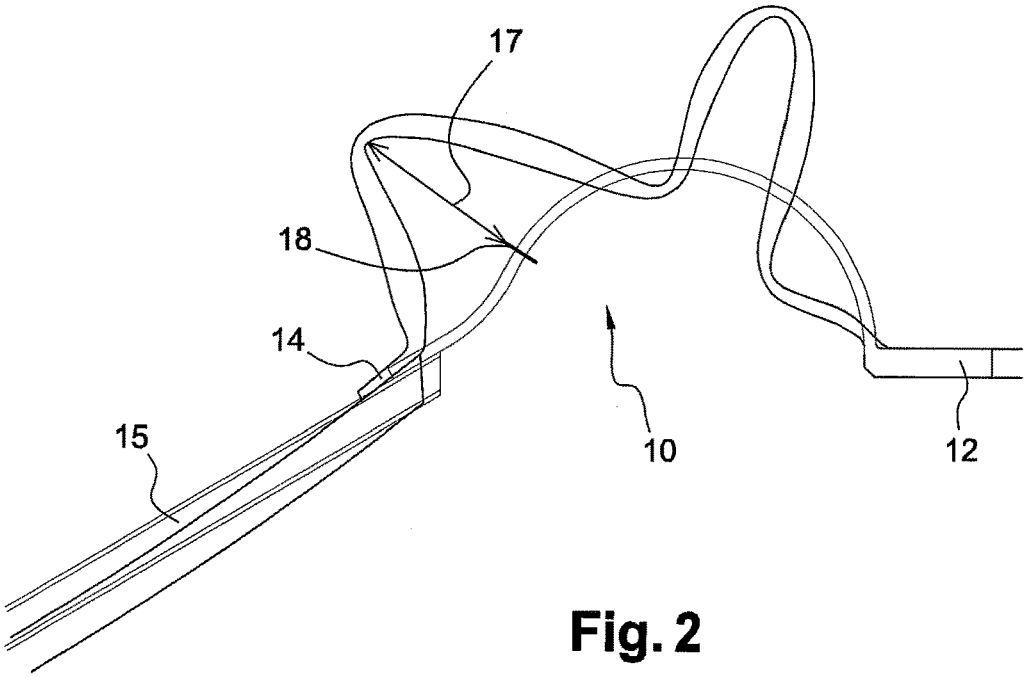
Figure 3:
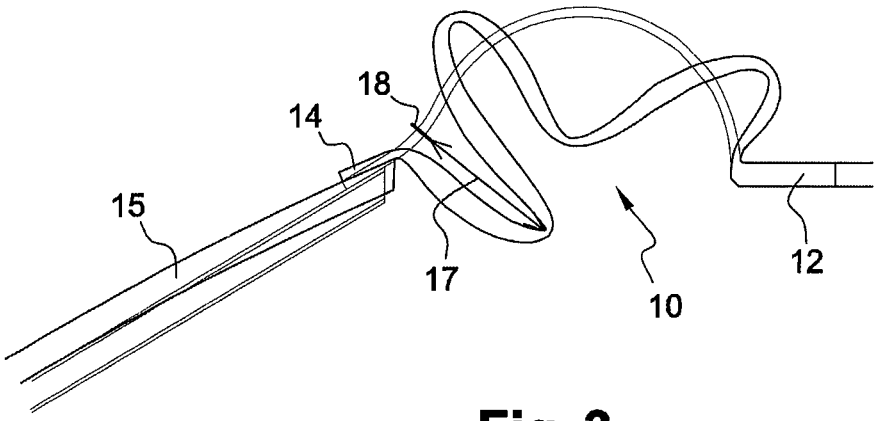
Figure 4:
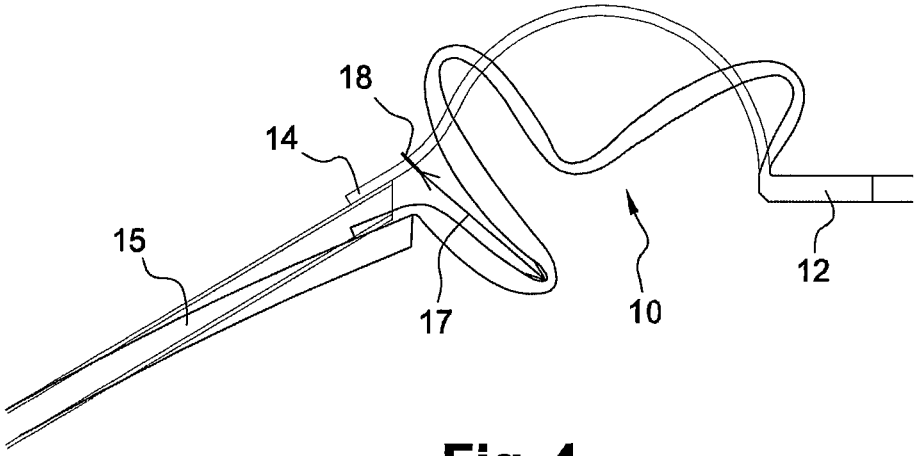

FIGS. 2 to 4 show the resonances induced into the suspension hoop 16 by the movements of the membrane 15. The resonances of the suspension hoop 16 during the characterization period are digitally captured by means of sampling and each sample is analyzed in order to detect the local maxima 17.

The measurements are preferably performed by means of an interferometry system. The suspension device 10 is placed on a dedicated support, and a laser is positioned on a mobile support on three axes in order to scan all the emitting surface of the suspension device 10. The laser is used to measure the movements of the suspension device 10 during the characterization period. This measurement makes it possible to obtain sound pressure and harmonic distortion graphs of the suspension device 10 during the characterization period.

FIGS. 2 to 4 represent three of these samples, with the suspension device 16 of FIG. 1 for reference. The local maxima correspond to the peaks and troughs formed by the suspension hoop 16 over time. The first maxima 17 and the projection thereof onto the suspension hoop 16 in the steady state (FIG. 1) is measured, i.e., the maxima 17 closest to the annular inner edge 14 able to fasten the suspension device 10 to a membrane 15.

Figure 5:
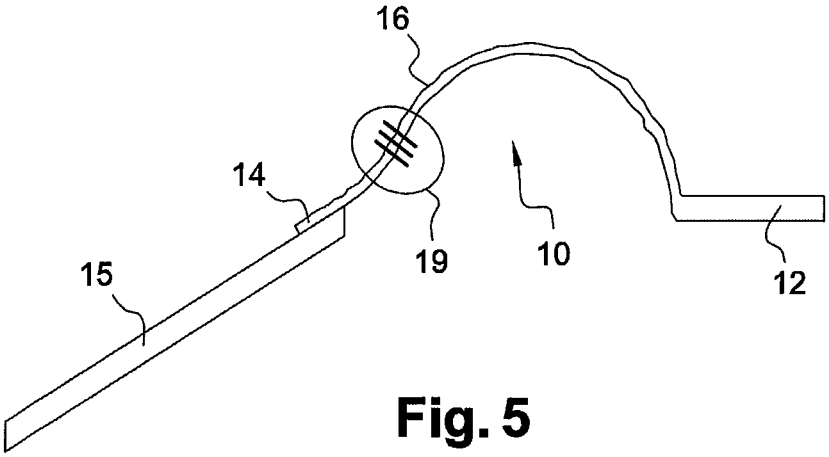

FIG. 5 shows that the projection of the maxima 17 is marked on the suspension hoop 16 in the steady state (FIG. 1) making it possible to determine the position of at least a protuberance 20.

The characteristic "positioned in such a way as to minimize at least a resonance mode" is thus interpreted in this document as positioned on the suspension hoop 16 at the first local maximum 17.

Figure 6:
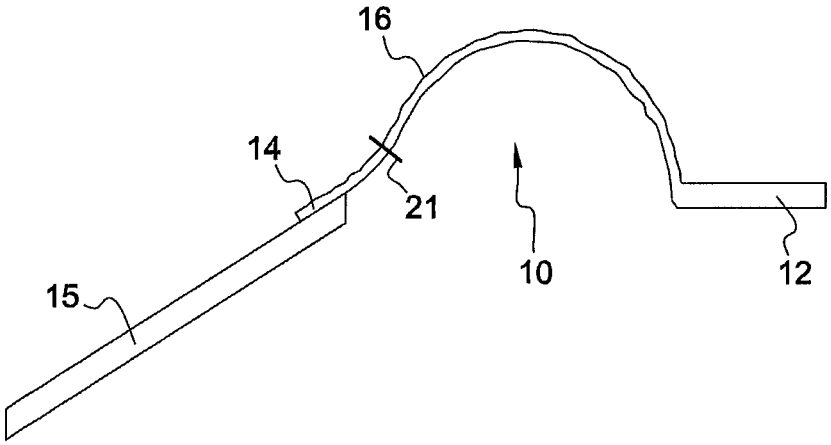

When several positions are determined, it may be useful to gather together the closest positions in order to avoid double detections that correspond to the same weakness of the suspension hoop 16. To do this, FIG. 5 reveals that the positions detected 18 are grouped together according to sets 19 wherein the distance is less than 20% of the total distance of the suspension hoop 16 in the steady state. The position of each protuberance 20 is then an average position 21 between the positions 18 of each set 19. FIG. 6 shows three averages positions 21 detected during an example of analysis for FIGS. 1 to 8.

A protuberance 20 is thus positioned on the suspension hoop 16 at the average position 21. The frequency response of the suspension device 10 can thus once again be studied and if the response is unsatisfactory, i.e., the improved suspension hoop 16 still has harmful resonance modes, a new protuberance 20 can be added.

Figure 7:
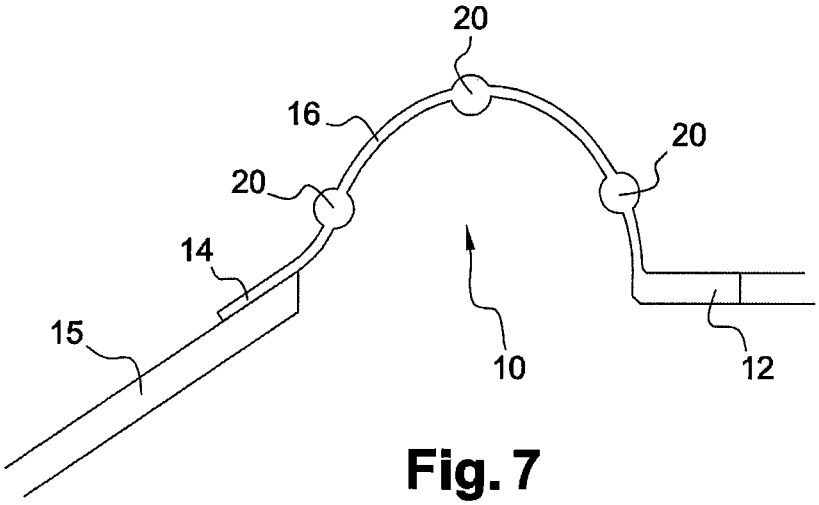

FIG. 7 illustrates a suspension hoop 16 according to a first embodiment of the invention improved by three protuberances 20 wherein the position corresponds to the average positions 21 detected during three consecutive improvements of the suspension device 10. The annular protuberances 20 consists of an even thickness of material with a circular radial cross-section.

Figure 8:
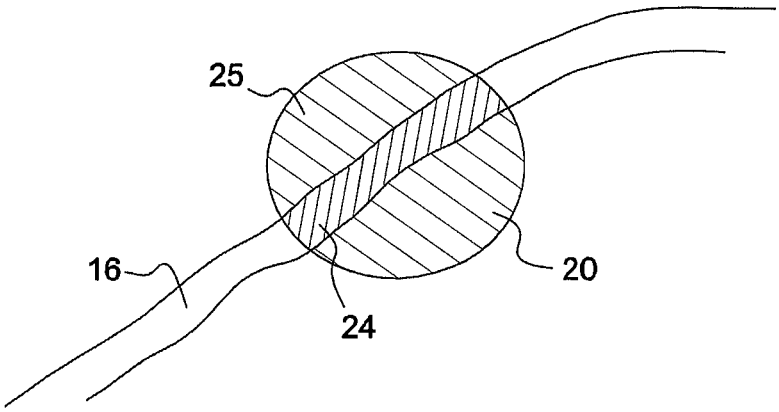

FIG. 8 illustrates that the size of the annular protuberances 20 is dampened in such a way that the mass (or for a homogeneous material, the volume) of each protuberance 20 is between 150% and 400% of the mass of a part of the suspension hoop 16 upon which at least an annular protuberance 20 is positioned. Thus, the volume 25 of the protuberance 20 is between 150% and 400% of the volume of the part of the suspension hoop 16 whereupon the protuberance 20 is located. Preferably, the volume 25 of the protuberance 20 corresponds to 250% of the volume 24 of the part of the suspension hoop 16.

Alternatively, the weight of each protuberance 20 can be numerically defined using a digital model of the suspension device 10. The dynamics of the suspension device 10 are then digitally modeled according to the measurements of the movements of the suspension hoop 16. The size of the protuberance 20 is found by means of a digital simulation of the previously defined model in such a way as to minimize the resonance modes and limit the impact of the weight of the protuberance 20.

The size of the protuberance 20 is modified between two numerical simulations in order to raise the mass ratio from 150% to 400% with a predefined calculation interval of approximately 10%. The response for each simulation is observed in order to calculate the amplitude of the oscillations of the suspension device 10 and the rigidity of the annular inner edge 14. The amplitude of the oscillations of the suspension device 10 makes it possible to numerically estimate the resonance modes. Therefore, this amplitude needs to be minimal. The rigidity of the annular inner edge 14 makes it possible to numerically estimate the impact of the weight of the protuberance 20. Therefore, this rigidity needs to be minimal. The more the weight of the protuberances 20 increases, the more the amplitude decreases and the more the rigidity increases. The main concern is to reduce the resonance modes and the weight of the protuberance 20 will then be numerically increased in the mass ratio of 150% to 400% up to the point of halving the amplitude of the oscillations in relation to the variations of the protuberance-free suspension device 10.

In another variant, the weight of each protuberance 20 can be defined based upon the maximum distance of the local maximum 17 in the stable state of the suspension hoop 16 during the characterization period while remaining within the mass ratio 150% to 400%.

Figure 9:
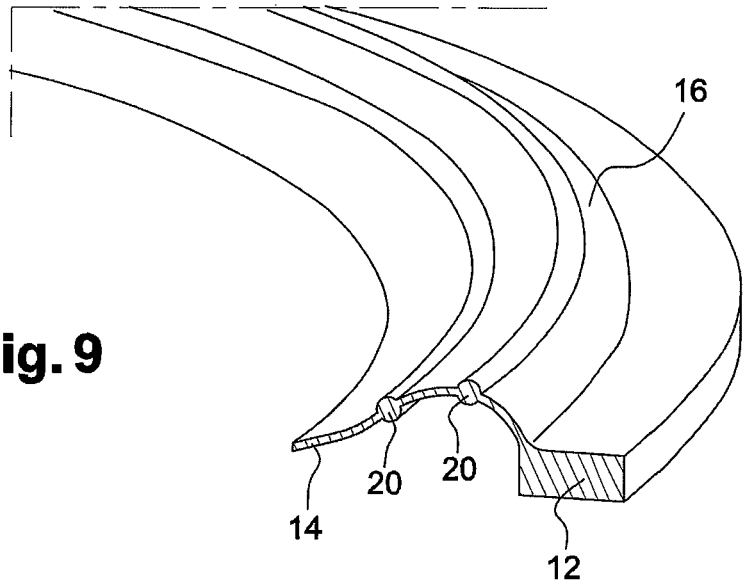
Figure 10:
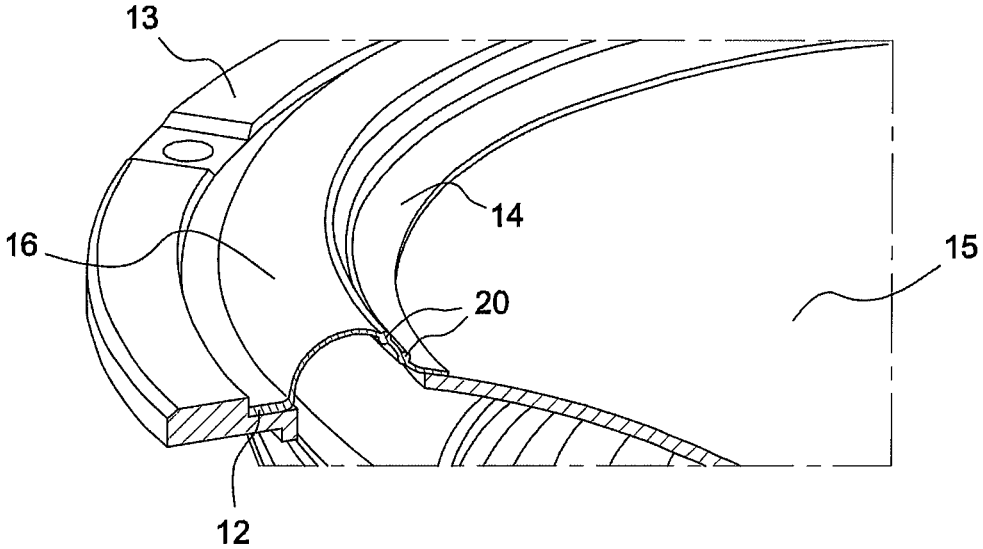
Figure 11:
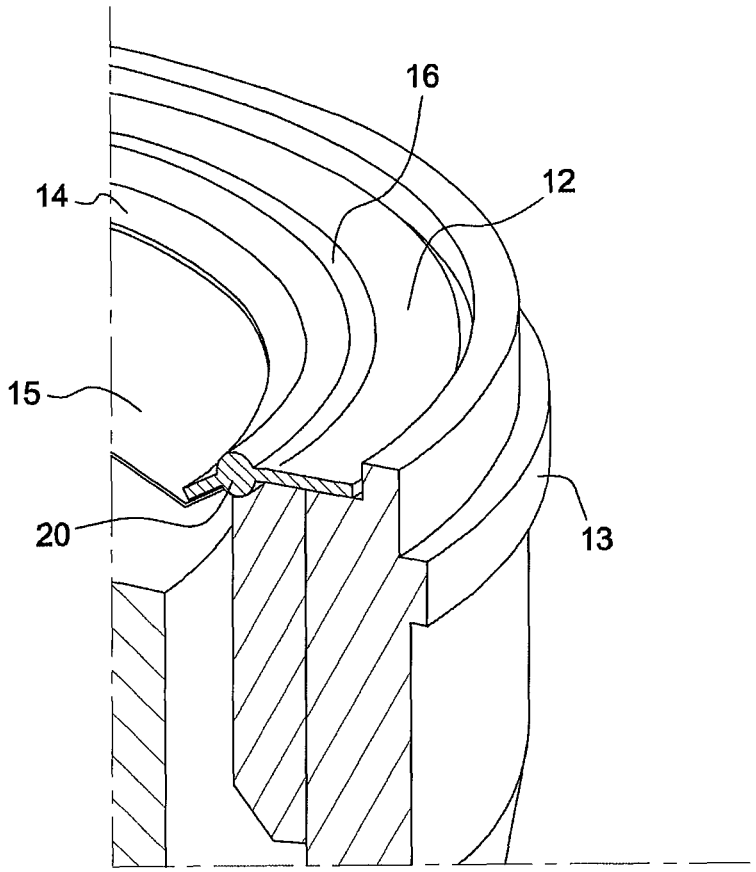

FIGS. 9, 10, and 11 reveal three different embodiments wherein the stresses applied to the suspension device are different. As a result, the number of protuberances differ, namely two for FIGS. 9 and 10 and only one for FIG. 11 and the position of the protuberances 20 also differs from FIGS. 9 to 11.

The invention thus makes it possible to suppress only those suspension hoop 16 oscillations that are identified as harmful to the quality of the sound. However, it does not aim to reduce all oscillations insofar as this would cause too large a reduction in the dynamics of the loudspeaker. Furthermore, the weight of the protuberances 20 is dampened in order to limit the degradation induced into the dynamics of the loudspeaker.

The invention makes it possible to propose a loudspeaker wherein the acoustic performance is increased by virtue of the device of the invention.

The invention claimed is:

1. Process for manufacturing a suspension device for a loudspeaker comprising:

providing an annular outer edge able to fasten the suspension device to a frame, an annular inner edge able to fasten the suspension device to a membrane, a suspension hoop extending annularly between the outer and inner edges, said suspension hoop being able to absorb movement stresses produced at the inner edge by means of deforming the suspension hoop thus forming at least one resonance mode, the suspension hoop comprises at least one annular protuberance positioned in such a way as to minimize at least one suspension hoop resonance mode, the mass of at least one of these annular protuberances being between 150% and 400% of the mass of a part of the suspension hoop whereupon the annular protuberance is positioned;

exciting the inner edge of the suspension device, measuring the movements of the suspension hoop in relation to a stable state of the suspension hoop during a characterization period, detecting the position of the first local maximum of the movements of the suspension hoop in relation to a stable state of the suspension hoop, and defining a position of a protuberance corresponding to a projection of the first local maximum on the suspension hoop in the stable state.

2. Process for manufacturing a suspension device according to claim 1, wherein the step consisting of defining a position of a protuberance further comprises the steps of:

defining at least a set of positions wherein the distance between the positions is less than 20% of the total distance of the suspension hoop in the stable state, and determining an average position of at least a set of positions corresponding to the position of the protuberance.

3. Process for manufacturing a suspension device according to claim 1, the step of exciting the inner edge of the suspension device performed with a characteristic signal wherein the frequencies change within a predetermined frequency range, preferably between 100 Hz and 10 KHz.

4. Process for manufacturing a suspension device according to claim 1, wherein the process further comprises the steps of:

digitally modeling the dynamics of the suspension device during a characterization period, and the movements of the suspension hoop in relation to a stable state of the suspension hoop, and defining the size of the protuberance by means of a digital simulation of the previously defined model in such a way as to minimize the resonance modes and limit the impact of the weight of the protuberance.

5. Process for manufacturing a suspension device according to claim 1, further comprising after the step of defining a position, the following steps:

once again exciting the inner edge of the suspension device that has been improved by positioning an annular protuberance on the device and when the suspension device still has harmful resonance modes, measuring the movements of the improved suspension hoop, i.e., with the annular protuberance, in relation to a stable state of the suspension hoop during a second characterization period, detecting the position of the second local maximum of the movements of the improved suspension hoop in relation to a stable state of the suspension hoop, and defining a position of a second protuberance corresponding to a projection of the second local maximum on the improved suspension hoop in the stable state.

* * * * *